US005676796A

United States Patent [19]

Cutts

[11] Patent Number: 5,676,796

[45] Date of Patent: Oct. 14, 1997

[54] MANUFACTURE OF PAPER

[75] Inventor: Paul Kenneth Cutts, West Yorkshire, United Kingdom

[73] Assignee: Allied Colloids Limited, West Yorkshire, United Kingdom

[21] Appl. No.: 592,394

[22] PCT Filed: Jun. 1, 1995

[86] PCT No.: PCT/GB95/01260

§ 371 Date: Feb. 1, 1996

§ 102(e) Date: Feb. 1, 1996

[87] PCT Pub. No.: WO95/33097

PCT Pub. Date: Dec. 7, 1995

[30] Foreign Application Priority Data

Jun. 1, 1994 [GB] United Kingdom ..... 9410920

[51] Int. Cl.[6] ..... D21H 21/10

[52] U.S. Cl. ..... 162/158; 162/164.1; 162/164.3; 162/164.6; 162/168.2; 162/168.3; 162/181.1; 162/181.2; 162/181.3; 162/181.6; 162/181.8; 162/183

[58] Field of Search ..... 162/168.1, 164.1, 162/168.2, 181.1, 168.3, 181.2, 164.6, 181.3, 181.6, 181.8, 183, 158, 199, 164.3, DIG. 4

[56] References Cited

U.S. PATENT DOCUMENTS

| | | | |
|---|---|---|---|
| 5,098,520 | 3/1992 | Begala | 162/168.1 |
| 5,126,014 | 6/1992 | Chung | 162/164.6 |
| 5,185,062 | 2/1993 | Begala | 612/168.1 |
| 5,240,561 | 8/1993 | Kaliski | 162/138 |
| 5,256,252 | 10/1993 | Sarkar et al. | 162/72 |
| 5,266,164 | 11/1993 | Novak et al. | 162/168.2 |
| 5,292,404 | 3/1994 | Hartan et al. | 162/164.6 |
| 5,368,692 | 11/1994 | Derrick | 162/181.8 |

FOREIGN PATENT DOCUMENTS

| | | | |
|---|---|---|---|
| 2020207 | 12/1991 | Canada | C08K 3/20 |
| 2102742 | 5/1994 | Canada | D21H 17/45 |
| 0 235 893 | 9/1987 | European Pat. Off. | D21D 3/00 |
| 0 335 575 | 10/1989 | European Pat. Off. | D21D 3/00 |
| 0 574 335 | 12/1993 | European Pat. Off. | D21H 21/10 |
| 0 586 755 | 3/1994 | European Pat. Off. | D21H 21/02 |
| 0 608 986 | 8/1994 | European Pat. Off. | D21H 23/76 |
| 60-57685 | 3/1994 | Japan | D21H 17/37 |
| WO 93/13265 | 7/1993 | WIPO | D21H 21/02 |

*Primary Examiner*—Peter Chin

*Attorney, Agent, or Firm*—Sughrue, Mion, Zinn, Macpeak & Seas, PLLC

[57] ABSTRACT

Paper is made by forming a thick stock cellulosic suspension, flocculating the thick stock by adding a relatively high molecular weight and relatively low cationic charge density polymer, diluting the flocculated thick stock to form a thin stock and then draining the thin stock to form a sheet. Usually coagulant is added to the thin stock before drainage and best results are achieved by adding coagulant followed by anionic colloidal material such as bentonite. The process can be operated to give good retention and good formation and, if the thick stock is dirty, to minimise pitch problems.

7 Claims, No Drawings

MANUFACTURE OF PAPER

This invention relates to the production of paper which may be filled or unfilled and may be lightweight or heavyweight. The paper may be, for instance, paper board.

It is standard practice to make paper by forming a thick stock cellulosic suspension from at least one thick stock-component cellulosic suspension, diluting this to form a thin stock, passing the thin stock towards a drainage screen through various items of apparatus such as a fan pump and/or a centriscreen, and draining the thin stock through the screen so as to form a sheet, which is then dried. The thick stock is usually made by blending several different thick stock-component suspensions. The thin stock and the resultant paper may be unfilled, but generally filler is included.

It is standard practice to include various polymeric materials and other additives during the process. For instance it is known to add to the thick stock polymeric materials variously described as pitch dispersants, pitch fixatives or runability aids. The term "pitch" is used as a generic term to refer to a variety of sticky materials that may be naturally occuring with the paper making fibres or that may be added as a result of, for instance, recycling waste paper that includes polymeric binder.

Pitch dispersants are low molecular anionic compounds that keep the pitch in dispersion. In view of the increasing tendency to recycle the drainage white water, this can lead to an unacceptable build up of dispersed pitch in the white water. It is therefore more common to include pitch fixatives or runnability aids. Pitch fixatives are intended to cause the pitch, while still in very fine dispersed state, to be deposited onto the paper fibres so as to prevent its accumulation in the suspension and its non-uniform and undesirable deposition as relatively large lumps on the paper or on the paper making machinery. Since the components of the pitch are generally regarded as anionic and since the paper making fibres are generally anionic, conventional practice has been to use, as pitch fixative, polymeric material having the highest possible cationic charge.

In practice, suitable polymers having maximum cationic charge (for instance being homopolymers of cationic monomer) all usually have a relatively low molecular weight, typically having molecular weight such that intrinsic viscosity is below 2, and often below 1, dl/g. Accordingly, the pitch fixatures that are conventionally used are low molecular weight, high cationic charge, polymers. Examples are polyethylene imine and polyDADMAC (diallyl dimethyl ammonium chloride homopolymer). The use of these low molecular weight polymers is reasonably convenient since they can be supplied as solutions that are easy to store and use. Accordingly the use of such polymers does not necessitate the provision of bulky dissolution apparatus such as is required when high molecular weight flocculant polymers are used as retention aids later in the system.

It is also known to add various other materials to promote pitch fixing. For instance bentonite is sometimes added to the thick stock for this purpose. The use of a low molecular weight polymer in combination with bentonite is described in W093/13265 and, for low molecular weight polymers of a particular molecular weight, in EP 586755.

There have been several recent proposals to improve pitch fixing or other properties by adding cationic polymers of DADMAC at various positions. Some such disclosures mention adding polymers to the thick stock wherein the polymers can fall within a wide range of molecular weights and cationic charge densities and so embrace high molecular weight polymers. In practice, however, the disclosures which relate to pitch fixing tend to be exemplified solely by the use of polymers which have high charge density, for instance above 3 meq/g and low molecular weight, for instance intrinsic viscosity below 4 dl/g.

Examples of relevant references includes CA 2,102,742 and U.S. Pat. Nos. 5,098,520, 5,185,062, 5,256,252, 5,266,164 and 5,292,404.

Although high cationic, low molecular weight, polymeric materials can serve as runnability aids and pitch fixatives, it is generally preferred to use them only when pitch or runnability problems are serious. This is because the cationic nature of the polymers can have an adverse effect on the brightness of the paper and because of the cost of the material that is used. We believe that part of this cost is wasted in the sense that we believe a significant proportion of the cationic polymeric pitch fixative does not serve to fix the pitch to the paper fibres but is, instead, absorbed into the paper fibres where it exerts little or no useful effect and may promote the deterioration in brightness.

It would therefore be desirable to be able to minimise pitch and runnability problems in a more economic manner and with reduced damage to brightness.

Some paper-making processes are conducted with the addition of an inorganic cationic coagulant (alum) to the stock but many processes are conducted in the absence of alum. A retention system comprising a polymeric retention aid is added during most paper-making processes. The polymeric retention aid causes flocculation of the cellulosic fibres and conventional thinking dictated that the amount of shear applied to the flocs should be minimised if optimum retention performance was to be obtained. In practice the polymeric retention aid and other components of the retention system are normally added to the thin stock and serve to promote retention, in the wet sheet, of fibre fines and any filler. This reduces the amount of cellulosic material and filler that drains through the screen. The retention system traditionally consisted of a single point addition of high molecular weight polymer immediately prior to the drainage screen, but various multipoint retention systems are also known in which different materials are added to the thin stock at different points.

In EP-A-235893 we describe a retention system in which a synthetic cationic polymer of molecular weight above 500,000 (and generally IV above 4 dl/g) is added to cause flocculation of the suspension, the flocculated suspension is subjected to shearing so as to reduce the flocs to microflocs, and bentonite is then added. It is explained in the specification that the polymer is generally added to the thin stock or with the dilution water that is used to convert the thick stock to the thin stock. It is also explained that the stock may already contain a strengthening agent, often a cationic starch.

The process of EP 235893 has been widely commercialised as the Hydrocol process (Hydrocol is a trade mark of Allied Colloids Limited) and is recognised as giving an extremely beneficial combination of retention, drainage rate, drying rate and product quality.

We describe in EP-A-335575 similar processes, but in which a low molecular cationic polymer is included before the high molecular polymer is added. It is stated that, inter alia, this would reduce pitch problems.

Other processes which use a low molecular weight polymer followed by a higher molecular weight polymer followed by shearing followed by anionic micro-particulate (colloidal) material are known and a typical disclosure is in U.S. Pat. No. 5,126,014.

The thick stock used in papermaking is generally formed from several pulps. Each pulp is generally free of polymeric material. However we have described in EP-A-0335576 and in EP-A-335575 processes in which the drainage of the pulp is improved by including a high molecular weight polymeric drainage aid in the suspension that is drained to form the pulp. However this polymer addition will contribute nothing towards solving the runnability or retention problems of a suspension made from such pulp. For instance flocs formed in the pulp will be degraded by the resuspension of the pulp into the thick stock and the polymeric flocculant in the pulp will mainly remain absorbed on the fibres and so will not be available to contribute to solving runnability problems due to the build-up of pitch and stickies derived from recycled broke or other chemical additives and which build up in the recycled water, particularly in closed mill systems.

It is always difficult to select a retention system so as to give the optimum blend of retention, drainage rate, drying rate and product quality and in practice every process requires selection of a compromise between the conflicting requirements of each of these properties. For instance, although it is generally possible to select materials and process conditions to obtain a good balance of properties by the Hydrocol process, on some mills and with some stocks it can be rather difficult to maintain good product quality ("formation") when obtaining optimum retention, drainage rate and drying rate. Formation is an indication of the distribution of fibres within the sheet. If the fibres are present as flocs or agglomerates the sheet will have rather high porosity (due to uneven density within the sheet) and is said to have poor formation. When the fibres are very uniformly distributed within the sheet, the sheet is said to have good formation.

Other paper-making processes may tend to give good formation, but at the expense of inferior performance properties such as retention or drying rate or drainage rate.

Achieving and maintaining an optimum balance of properties is becoming increasingly difficult as a result of the trends towards use of increasing amounts of recycled paper, optionally after deinking, and towards closing the mill water circuit so that whitewater is recycled for prolonged periods at the mill and so is liable to accumulate a high electrolyte or other impurity content. These trends also result in increasing pitch problems.

It would be desirable to provide a new retention system that easily allowed a better or different combination of retention, drainage, drying and formation properties than is easily obtainable in the Hydrocol process, and in particular it would be desirable to provide such a retention system that allowed the easy attainment of better formation while maintaining similar retention and/or drainage and/or drying properties, or which allowed maintenance of satisfactory formation while giving improved retention and/or drainage and/or drying properties.

According to one aspect of the invention, we make paper by a process comprising forming a thick stock cellulosic suspension having a solids content of at least 2.5% by weight from at least one thick stock component cellulosic suspension having a solids content of at least 2.5% by weight, flocculating the thick stock by adding to the thick stock or to at least one thick stock component suspension a synthetic, substantially water soluble, first, polymeric material having intrinsic viscosity of at least 4 dl/g, diluting the flocculated thick stock to form a thin stock having a solids content of not more than 2% by weight, coagulating the thin stock by adding to the thin stock a coagulant selected from an inorganic coagulant and/or a second, water soluble, polymeric material having intrinsic viscosity of less than 3 dl/g, draining the coagulated thin stock through a screen to form a sheet, and drying the sheet.

Thus, in this process, the thick stock is initially flocculated, these flocs are inevitably subjected to degradation as the thick stock is diluted to thin stock and the thin stock is passed towards the screen, and this suspension is coagulated before drainage. By saying that it is coagulated we mean that the suspended material is aggregated into relatively small dense flocs, in contrast to the large flocs that would be obtained if a conventional high molecular weight polymeric retention aid (for instance intrinsic viscosity above 4 and generally above 8 dl/g) was used.

Sufficient coagulation may be attainable merely by the addition of inorganic coagulant and/or the low molecular weight polymeric coagulant, but generally it is desirable to achieve the state that is now frequently referred to as "supercoagulation" by adding anionic colloidal material to the thin stock after the addition of the inorganic and/or polymeric coagulant. Thus the preferred process according to the invention comprises adding to the thin stock the inorganic coagulant and/or low molecular weight water soluble polymeric coagulant and then adding the anionic colloidal material.

Such processes can be operated to give good retention and drainage and drying properties accompanied by good formation. In particular, the process of the invention gives the opportunity of achieving better formation than is obtainable with some known retention systems while maintaining equivalent retention and/or drainage and/or drying properties, and it allows the attainment of improved retention and/or drainage and/or drying properties while obtaining equivalent or better formation. Additionally, if the thick stock would, in the absence of the first polymer, tend to result in the process incurring pitch deposition or runnability problems, then the process has the advantage of additionally minimising these problems. It achieves this without the disadvantage of damaging the brightness of the sheet too much.

In addition to providing improved formation whilst maintaining satisfactory or good retention, a further advantage of the process is that it can easily reduce pitch problems. Thus the addition of the high molecular weight polymer to the thick stock will normally reduce pitch problems by acting as a pitch fixative in the machine chest or other place where the high molecular weight polymer is incorporated into the thick stock.

One way of observing decreased pitch problems is to observe the filtrate turbidity of the flocculated thick stock, as explained below, and the process of the invention will normally result in reduction, and usually in significant reduction, of the filtrate turbidity of the flocculated thick stock. Accordingly it is preferred that the high molecular weight polymer, and the amount that is used, in the thick stock are such as to give this effect.

The invention also includes processes in which pitch problems are reduced irrespective of the particular retention systems, if any, which are utilised on the thin stock.

Accordingly a second aspect of the invention includes a process in which paper is made by a process comprising forming a thick stock cellulosic suspension having a solids content of at least 2.5% by weight from at least one thick stock-component cellulosic suspension having a solids content of at least 2.5% by weight, flocculating the thick stock by adding to the thick stock or to at least one thick stock-component suspension a synthetic, substantially water soluble, first, polymeric material having a theoretical cationic charge density of less than 3 meq/g and intrinsic viscosity of at least 4 dl/g, preferably in an amount that significantly reduces filtrate turbidity of the flocculated thick stock, diluting the flocculated thick stock to form a thin stock having a solids content of not more than 2% by weight, draining the thin stock through a screen to form a sheet, and drying the sheet.

The process generally includes adding a retention promoter system to the thin stock before drainage, and this retention promoter system is usually selected from (a) adding a polymeric retention aid selected from synthetic polymers having intrinsic viscosity above 4 dl/g and cationic starch, (b) adding anionic colloidal material (usually immediately before draining), (c) adding a polymeric retention aid selected from synthetic polymer having intrinsic viscosity above 4 dl/g and cationic starch followed by anionic colloidal material (generally immediately before draining), (d) a coagulant selected from inorganic coagulant and water soluble polymeric material having IV less than 3 dl/g and (e) a coagulant selected from inorganic coagulant and water-soluble polymeric material having intrinsic viscosity of less than 3 dl/g followed by anionic colloidal material. The preferred processes are (d) and (e), especially (e) since such processes combine the benefits of good retention, good formation and minimum pitch problems.

In this specification, intrinsic viscosity is measured at 25° C. in 1M sodium chloride buffered at pH7 using a suspended level viscometer.

In this specification theoretical cationic charge density is the charge density obtained by calculation from the monomeric composition which is used for forming the polymer.

In this specification dosages of polymer or other materials that are expressed as a percentage are expressed as percentage dry polymer based on the dry weight of the suspension that is being treated, and so 0.01% dosage represents 100 grams dry polymer per 1 tonne dry weight of suspension.

In this specification, filtrate turbidity is the turbidity of the filtrate obtained by filtering the flocculated suspension through a fast filter paper, followed by measuring the turbidity optically in a clean cuvette in a turbidity meter that operates on the diffused light double beam principle (such as a Dr. Lange turbidity meter) and which expresses the result in NTU.

By saying that the flocculant is added in an amount that significantly reduces filtrate turbidity we mean that the turbidity of the filtrate from the suspension to which the flocculant has been added is significantly less than the turbidity of the filtrate obtained from the same suspension but to which flocculant had not been added. For instance the filtrate turbidity of the flocculated suspension is generally below 50%, preferably below 30% and most preferably below 20% of the filtrate turbidity of the suspension prior to addition of the flocculant.

Another way of indicating that filtrate turbidity has been significantly reduced is by reference to the amount of flocculant required to give optimum (i.e., lowest) filtrate turbidity. When the filtrate turbidity is recorded for increasing amounts of flocculant polymer, it will be found that turbidity decreases to a minimum and then increasing the amount of polymer results in increased turbidity. It is therefore easily possible to determine the amount of flocculant polymer that gives optimum (minimum) turbidity in any particular suspension. Best results in the invention are generally obtained when the amount of flocculant polymer that is added is at or near the optimum. However this is not always essential. Thus good results can be obtained in the invention when the amount of flocculant polymer is at least 25%, preferably at least 50% and most preferably at least 75% of the optimum amount, i.e., the amount that gives optimum (minimum) filtrate turbidity. It is generally preferred that the amount of polymer should not be too much above the optimum since increasing turbidity tends to indicate inferior performance and wasted polymer. However it is sometimes found that the turbidity obtainable at the optimum dose is so low that significant variations in the dose can be used without seriously impairing the control of pitch, and the use of excess polymer may be useful in the subsequent retention stages of the process. Accordingly it is normally satisfactory for the amount of polymer to be up to 200% of the optimum and often it is up to 300% or even 500% of the amount for optimum filtrate turbidity.

In practice the amount of polymer added at this thick stock stage is at least 0.005% and generally at least 0.01%. Usually it is in the range 0.03 to 0.15 or 0.2%. However higher amounts, up to 0.5% or even 1% or more can be used.

Although filtrate turbidity can be due in part to components that are not associated with pitch deposition problems, as a rough guide we believe that low filtrate turbidity is usually associated with low tendency towards pitch deposition problems. Accordingly, when minimisation of pitch deposition is the primary objective of adding the polymer to the thick stock, the dosage of polymer will normally be selected so that the filtrate turbidity is as low as possible.

As indicated above, the prior art indicates that cationic polymers used as pitch fixatives should have high cationic charge and low molecular weight and it is very surprising that in the invention good results can be achieved using a high molecular weight, low cationic, polymer. The invention has the particular advantage that the use of such polymers tends to result in less damage to the brightness of the sheet less than occurs when traditional high cationic low molecular weight polymers are used for this purpose. It seems that, provided the polymer has high molecular weight (IV above 4 dl/g), satisfactory substantivity to the pitch and to the fibres is achieved even though the cationic charge is low. Since the cationic charge is low, there is less optical damage to the fibre sheet. Since the molecular weight is high, there is less risk of wastage of polymer due to absorption in the fibres. Accordingly the invention can result in lower filtrate turbidity at equivalent polymer dosage and lower optimum filtrate turbidity (combined with less brightness loss) at equivalent dosage of polymer, and less brightness loss at optimum filtrate turbidity, compared to conventional high cationic low molecular weight polymer.

The flocculant polymer can be used as the only pitch fixative or runnability aid in the process but it can be used in combination with other materials that are included deliberately for this purpose or which may be included for another purpose but which may have a beneficial effect on pitch fixation. For instance cationic starch or other dry strength resin may be added. Bentonite or other anionic colloidal material may be added either before, with or after the addition of the flocculant. Since the bentonite or other anionic colloidal material may tend to interact with the polymeric flocculant to produce very large flocs, it is generally desirable that the thick stock should be subjected to sufficient agitation to prevent the formation of such flocs or to degrade them if they are formed.

The flocculant polymer that is used in the thick stock may be substantially non-ionic or anionic (especially when the thick stock has a high electrolyte content) but generally is cationic. The theoretical cationic charge density should be not more than around 3 meq/g because otherwise the advantages of using a relatively low cationic polymer (cost of cationic monomer and minimisation of brightness loss) will decrease, and generally it is below 2 meq/g. Usually it is at least 0.1, and more usually at least 0.5 meq/g. Suitable polymers are described in more detail below under the description "first polymers".

The flocculation of the thick stock has the described beneficial effects on pitch fixing but can also be beneficial for subsequent retention treatments even though passage of the flocculated thick stock towards the screen will inevitably result in degradation of the flocs, possibly with some resuspension of fibres, to form smaller flocs that can be termed microflocs. If no subsequent retention treatment is applied, this degradation may be such that retention properties are rather poor and so preferably a retention system is applied to the thin stock formed by diltuion of the thick stock. Any conventional retention system can be used.

In one process, improved retention is achieved by the use of a single component polymeric retention aid at a later, thin stock, stage in the process, for instance just before drainage, e.g., after the last point of high shear. For instance polymeric retention aid can be added just prior to or at the headbox. This polymeric retention aid is usually a synthetic polymer which generally has IV at least 4 dl/g. It may be anionic, non-ionic or cationic. Routine experimentation will establish which type of polymer gives best results on the particular thin stock. For instance if the thin stock has a relatively high cationic content then it may be appropriate to use a non-ionic or anionic polymeric retention aid, but otherwise a cationic retention aid is generally preferred. Although high IV synthetic polymer is preferred, cationic starch can be used in place of some or all of the synthetic polymer.

Instead of using polymer alone, it can be used in combination with other materials. For instance bentonite or other anionic particulate material may be added to the thin stock or to the thick stock, generally after flocculation of it, and the polymeric retention aid may be added subsequently. Again the retention aid may be anionic, non-ionic or cationic. Such a process using substantially non-ionic retention aid is described in EP-A-017353. In a variation on this process, as described in AU 63977/86, a highly cationic polyelectrolyte, generally of relatively low molecular weight, may be added after adding the bentonite and before adding the final polymeric retention aid.

In another variation of this process, as described in unpublished European application 94300260.0 at least one thick stock component contains filler and the filler is coagulated with the fibres in that component suspension by adding cationic coagulating agent to the suspension containing filler and fibre, followed by the addition of the anionic particulate material such as bentonite and then the polymeric retention aid. In all these processes, the final retention aid generally has IV at least 6 dl/g and is generally a substantially water-soluble polymer formed by polymerisation of acrylamide or other water-soluble ethylenically unsaturated monomer optionally with ethylenically unsaturated cationic monomer and/or anionic monomer.

Instead of adding polymeric retention aid as the retention system, it is sometimes possible to obtain good results merely by the addition of anionic colloidal material, for instance after the last point of high shear to which the thin stock is subjected, typically at or close to the head box. This can give good results especially when the polymer that was added at the thick stock was cationic polymer present in sufficient excess that the suspended particles that are approaching the drainage stage have a sufficient cationic charge to interact with and be flocculated by the anionic colloidal material. Suitable anionic colloidal materials are described in more detail below.

Although the invention has the advantage of permitting reduction in pitch problems, it should be understood that the preferred aspects of the invention are aimed at achieving good formation and retention irrespective of pitch problems and are, in particular, processes (d), or preferably (e) above. Thus in such processes the thick stock may be a material which does not require this pitch fixative addition. For instance the thick stock may have been made from clean stock components having low tendency to deposit pitch or other components which will act as pitch fixatives may be included in the thick stock. For instance cationic starch or conventional low molecular weight, high cationic, polymeric pitch fixatives may be included in a dirty thick stock or thick stock component such that the thick stock does not suffer from significant pitch deposition problems.

When pitch problems do not dominate the considerations for the amount of polymer that is to be added to the thick stock, the amount can be selected having regard primarily to the requirements of the later stages of the process rather than having regard to the filtrate turbidity of the flocculated thick stock. For instance if the retention system that is being used performs best when the thick stock has been treated with an excess of cationic high molecular weight polymeric material then the amount of this material may be significantly above the amount required for minimum filtrate turbidity and the filtrate turbidity of the flocculated suspension may be almost as much as the filtrate turbidity of the suspension in the absence of the polymer. Generally, however, the amount of polymer should still fall within the ranges discussed above in the context of filtrate turbidity.

In the process of the invention, the final paper may be filled or unfilled. If it is filled, the amount of filler can be from, for instance, 2 to 60%, often 10 to 60% by weight of the solids content of the sheet. Any of the conventional fillers can be used. Some or all of the filler can be introduced by the use of recycled paper. Some or all of the filler can be included in the thick stock. The solids content of the thick stock is generally not more than 7% and is usually in the range 2.5 to 5% by weight.

The source of the cellulosic component of the suspension can be recycled paper or any convenient pulp, for instance mechanical, thermomechanical or chemical pulp. The pulp may be relatively pure or it may be a relatively crude pulp. It may have been generated by redispersing a dried pulp or, in an integrated mill, it may have been generated by a previous pulping stage at the mill. The pulp, or the dried pulp, may have been made by the use of a dewatering aid but usually it is free of polymeric material when it is introduced as a thick stock component or as the thick stock.

The thick stock can be provided from a single component suspension but usually is made by blending two or more thick stock component suspensions.

In the invention the first polymeric material is added to the thick stock, or to one or more of the thick stock components, in an amount sufficient to substantially completely flocculate the thick stock, for instance as indicated by reference to filtrate turbidity (all as discussed above). The first polymer may be added to each thick stock component but frequently the first polymer is added to the total thick stock, for instance in the thick stock mixing chest or holding chest. Alternatively it can be added in the pulper.

The suspension will inevitably be subjected to extensive mixing and shear before it is drained (as a thin stock) and therefore it is not essential that total and uniform distribution of the polymer should be achieved immediately upon its addition to the thick stock or thick stock component. Accordingly in the invention it is permissible to add the polymer as a reverse phase emulsion which will be activated, so as to provide a solution of the polymer, in the thick stock, but preferably the polymer is added to the thick stock or thick stock component as a preformed solution. This may have been generated in conventional manner by dissolution of a powder or reverse phase emulsion form of the first polymer.

The first polymer has intrinsic viscosity (suspended level viscometer in buffered 1N sodium chloride at 25° C.) of at least 4 dl/g and often at least 6 dl/g, for instance 6 to 25 dl/g or higher, often 8 to 15 dl/g.

Useful processes of the invention use, as the first polymer, copolymers of water soluble ethylenically unsaturated monomer or monomer blend. The monomers are generally acrylic monomers. The monomers may include cationic monomer in an amount such that the theoretical charge density (as defined above) is not more than about 3 meq/g, and is often not more than about 2 meq/g. Generally it is at least about 0.1, or more usually about 0.5, meq/g.

Suitable cationic monomers are dialkyl amino alkyl—(meth) acrylates or —(meth) acrylamides, generally as acid salts or, preferably, quaternary ammonium salts. The alkyl groups may each contain 1 to 4 carbon atoms and the aminoalkyl group may contain 1 to 8 carbon atoms. Particularly preferred are dialkylaminoethyl (meth) acrylates, dialkylaminomethyl (meth) acrylamides and dialkylamino-1,3-propyl (meth) acrylamides.

The first polymer is generally a copolymer of cationic monomer with other monomers, wherein the amount of cationic monomer is usually at least 2, and most usually at least 3, mole percent. The amount of cationic monomer in some instances may be up to 25 mole percent but generally is not more than 20 mole percent and is frequently not more than 10 mole percent. Quaternised diallyl dialkyl monomers, especially diallyl dimethyl ammonium chloride (DADMAC), can be used provided the proportions and polymerisation conditions are such that the final polymer has the desired high IV and relatively low charge density.

The cationic monomer is copolymerised with a water soluble ethylenically non-ionic unsaturated monomer, preferably acrylamide. Generally the polymer is a copolymer solely of cationic and non-ionic monomers but if desired a small amount of anionic monomer may be included in the copolymer, provided the final polymer still behaves primarily as a cationic monomer.

In some instances, the characteristics of the thick stock (and in particular its electrolyte content) are such that satisfactory flocculation can be achieved using a substantially non-ionic polymeric flocculant (for instance containing very small amounts of cationic monomer or, more usually, consisting solely of non-ionic monomer and impurity monomers such as 1 to 3 mole percent sodium acrylate) or an anionic polymeric flocculant. Suitable anionic polymeric flocculants are copolymers of acrylamide or other water soluble non-ionic monomer with up to 10 or 20 mole percent anionic monomers.

Anionic monomer present in the first polymer is usually acrylic acid (usually as sodium acrylate) but can be any convenient ethylenically unsaturated carboxylic or sulphonic monomer. The selection of the optimum type of first polymer can be made by monitoring the flocculation performance of a range of polymers having different ionic content, for instance a low anionic, a non-ionic and a low and medium cationic polymers, so as to determine which type of polymer gives the best flocculation performance on the thick stock either having regard to filtrate turbidity or having regard to the subsequent requirements of the addition of coagulant and anionic colloidal material. With most thick stocks, best results are achieved when the first polymer is a low to medium cationic polymer.

The polymer must be sufficiently soluble in water in order that it does not cause imperfections in the paper sheet, but it can be lightly cross linked so that it is a blend of water swellable polymer particles below 10 μm and water soluble polymer, for instance as described in EP 202780.

The conventional dilution stages and other processing stages leading to the machine wire necessarily subject the suspension to turbulence and shear and this will inevitably result in degradation of the initial flocs and possibly some resuspension of fibres. The dilution, for instance with white water from the wire, generally gives a thin stock having a solids content of 0.3 to 2%.

In the preferred process of the invention the resultant microflocs and/or resuspended material is treated by the addition of one or more coagulants so as to prepare the suspension for subsequent drainage, and generally for super coagulation by a subsequent addition of anionic colloidal material followed by drainage.

In this specification, we are using the term "coagulant" in the sense of denoting any material that has the effect of causing the fibres and filler particles (if present) in the thin stock to aggregate together to form small dense microflocs prior to drainage or super coagulation, or in some instances merely to be more susceptible to super coagulation even if there is no visible aggregation prior to the addition of the anionic colloidal material.

The coagulant that is added can be an inorganic material and/or it can be a second organic polymeric material. If it is a polymeric material it must have low intrinsic viscosity since it is undesirable for the second material to induce significant bridging flocculation of the type that is generated by high molecular weight polymers. Bridging flocculation at this stage may detract from the formation properties of the final sheet. The addition of the second polymer may appear to cause some aggregation but, because of the low molecular weight, this aggregation will not detract from the formation properties that are desired. The intrinsic viscosity is not more than 3 dl/g and is generally below 2 dl/g and even below 1 dl/g. Expressed as molecular weight measured by gel permeation chromatography, the molecular weight of the second polymer is usually below 500,000, preferably below 400,000. Most preferably it is below 300,000. Generally it is above 50,000.

The flocs formed as a result of the addition of the first polymer may have an excess surface cationic charge, due to the first polymer. The degradation of these flocs that occurs during dilution and flow of the thin stock towards the screen will result in the exposure of anionic or non-ionic sites on the microflocs or resuspended solids. In many processes of the invention it is desirable for the second polymer to be cationic so as to increase the cationic charge on the microflocs and suspended solids before the addition of the anionic colloidal material. Accordingly in many processes it is desirable for the second polymeric material to be cationic, and in particular it is generally preferred for the cationic charge on the second polymer to be high. Thus the second polymer generally has a theoretical cationic charge of above 4 meq/g and often above 5 meq/g.

When the second polymer is cationic, it is preferably formed of recurring units of which at least 70%, and generally at least 90%, are cationic. Preferred polymers are homopolymers of diallyl dimethyl ammonium chloride and co-polymers of this with a minor amount (usually below 30% and preferably below 10%) acrylamide, homopolymers of dialkylaminoalkyl (meth) -acrylamide or -acrylate quaternary salt or acid addition salt and copolymers of these with small amounts (generally below 30% and preferably below 10%) acrylamide, polyethylene imines, polyamines, epichlorhydrin diamine condensation products, dicyandiamide polymers and other conventional low molecular weight cationic coagulant polymers.

Instead of using cationic coagulant polymer alone for increasing the cationic charge on the particles in the suspension, it is possible to add inorganic coagulant, and in some instances inorganic coagulant alone may be used. Suitable cationic inorganic coagulants include polyvalent metal compounds such as alum, aluminium chloride, polyaluminium chloride, ferric sulphate and ferric chloride.

If the thin stock has too high a cationic charge, for instance due to the use of an excess amount of cationic starch or an excess amount of first cationic polymer, coagulation may be brought about by neutralising some of the cationic charge by adding anionic material. Suitable anionic coagulants include inorganic anionic coagulants such as polyphosphate, polyphosphonate and polysulphonate, and organic coagulants such as low molecular weight, water soluble, polymers of ethylenically unsaturated monomer or monomer blend that includes anionic monomer. For instance a suitable polymer is a polymer of sodium acrylate (or other water soluble anionic monomer) either as a homopolymer or copolymerised with, for instance, 0 to 50 mole percent acrylamide or maleic anhydride. The molecular weight of polymeric anionic coagulants typically is such that intrinsic viscosity is below 3 dl/g, generally below 2 dl/g and most usually below 1 dl/g. Expressed as molecular weight measured by gel permeation chromatography, the molecular weight is usually below 100,000, generally below 50,000 and frequently below 15,000. Often it is in the range 2 to 10,000. It should be noted that many of the materials proposed for use in the invention as anionic coagulants are materials that, in other environments, would normally be regarded as anionic dispersants.

If the thin stock is near neutral charge, and especially if the thin stock has a high electrolyte content such that it has high conductivity, then best results may be achieved using a coagulant which is a substantially non-ionic polymer that provides coagulation by hydrogen bonding. Suitable polymers are polyethylene oxide and polyacrylamide. The molecular weight must be such that the aggregates are reasonably small, and so again molecular weight measured by GPC is preferably below 1 million or 500,000 and measured by intrinsic viscosity is preferably below 3 dl/g.

When inorganic coagulant is being used in place of the second polymer, the amount of coagulant will be selected by routine experimentation and will generally be in the range 0.01 to 1%. When second polymer is being used, the amount of second polymer is usually at least 0.01% and generally at least 0.03%, dry weight based on the dry weight of the suspension. It can be up to 0.2% or even high, for instance up to 0.5%, but is generally below 0.1%. Preferably the amount is sufficient to give aggregation of the fibres which is visible to the naked eye.

Although it is permissible to subject the microflocs to additional agitation and shear after application of the second polymer, this is generally undesirable and so generally the second polymer is added as late as convenient prior to drainage or, more usually, prior to the addition of the anionic colloidal material.

Because the second polymer is of low molecular weight it may be possible to incorporate it in the form of rapidly dissolving beads or other polymer particles but it is generally preferred to add the second polymer as a preformed solution.

The anionic colloidal material can be any anionic material that gives a very high anionic surface area and that does not detract unacceptably from the properties of the final paper. It can be an anionic organic polymeric emulsion, preferably having an average particle size below 2 μm and preferably below 1 μm, and most preferably below 0.1 μm. The emulsified particles may be insoluble due to being formed of a copolymer of, for instance, a water-soluble anionic polymer and one or more insoluble monomers such as ethyl acrylate. Preferably, however, the organic polymeric emulsion is a cross linked microemulsion of water-soluble monomeric material.

Preferably, however, the anionic colloidal material is an inorganic material such as colloidal silica, polysilicate microgel, polysilicic acid microgel, aluminium modified versions of any of the foregoing, or preferably, an anionic swelling clay. This may be any of the materials generally referred to as bentonite, hectorites or smectites or even other anionic inorganic materials such as zeolites. The preferred materials are those that are generally referred to in the industry as bentonites. The amount of bentonite or other material that is added is typically in the range 0.03 to 2%, the amount preferably being at least 0.1% and preferably below 1%.

Although we refer to the anionic colloidal material as causing super coagulation, this aggregated structure encompasses any aggregation of the microflocs and resuspended fibres into a form that provides good retention and dewatering characteristics accompanied by good formation in the final sheet.

The bentonite or other colloidal material is generally added after the last point of high shear, for instance in the head box, and the suspension can then be drained in conventional manner.

The following are examples.

EXAMPLE 1

In order to demonstrate the improvement in brightness that is achieved by incorporating into the thick stock a low cationic high molecular weight polymer instead of a high cationic low molecular weight polymer, the following laboratory test was conducted.

250 cc of stock formed from TMP pulp is treated with various amounts of the test polymer solution and the dosage (percentage dry polymer based on dry stock) is recorded. The stock is stirred for 30 seconds at 1000 rpm and filtered under vacuum with the aid of a Whatman 541 filter paper and the filtrate was collected.

The pads are flattened with the aid of a Couch roll, the filter papers removed and then dried for 2 hours at 110° C. The brightness results are then determined on a scale where reducing the value indicates lower brightness. Filtrate turbidity is recorded, on a scale where decreasing values indicate improved results (less turbidity).

In this test, polymer A is poly DADMAC IV 0.4 dl/g.

Polymer B is poly DADMAC IV 2.0 dl/g.

Polymer C is a copolymer of 90 mole % acrylamide with dimethylaminoethyl acrylate quaternised MeCl IV 8 dl/g.

Polymer D is a copolymer of 65 mole % acrylamide and dimethylaminoethyl acrylate quaternised MeCl IV 7 dl/g.

The results are shown in Table 1 below.

TABLE 1

| Product Used | Product Dosage % | Filtrate Turbidity (NTU) | Pad Brightness | Brightness Loss |
|---|---|---|---|---|
| — | 0 | 65.8 | 61.15 | 0 |
| A | 0.025 | 64.8 | 60.2 | 0.95 |
| | 0.05 | 55.0 | 60.45 | 0.7 |
| | 0.1 | 43.8 | 60.15 | 1.0 |
| | 0.2 | 31.9 | 59.85 | 1.3 |
| | 0.4 | 20.3 | 58.7 | 2.45 |
| | 0.8 | 16.1 | 60.2 | 0.95 |
| B | 0.025 | 57.9 | 61.2 | −0.05 |
| | 0.05 | 40.2 | 60.4 | 0.75 |
| | 0.1 | 24.6 | 59.8 | 1.35 |
| | 0.2 | 14.9 | 58.55 | 2.6 |
| | 0.4 | 9.3 | 59.2 | 1.95 |
| | 0.8 | 21.0 | 59.4 | 1.75 |
| | 1.6 | 53.4 | 61.15 | 0 |
| C | 0.0125 | 44.7 | 61.3 | −0.15 |
| | 0.025 | 21.2 | 60.15 | 1.0 |
| | 0.05 | 18.1 | 60.4 | 0.75 |
| | 0.1 | 6.1 | 60.95 | 0.2 |
| | 0.2 | 4.5 | 60.25 | 0.9 |
| | 0.4 | 4.4 | 60.75 | 0.4 |
| | 0.8 | 9.7 | 60.55 | 0.6 |
| | 0.16 | 24.6 | 60.35 | 0.8 |
| D | 0.0125 | 48.8 | 60.25 | 0.9 |
| | 0.025 | 26.8 | 60.05 | 1.1 |
| | 0.05 | 12.1 | 60.05 | 0.65 |
| | 0.1 | 5.0 | 60.05 | 1.1 |
| | 0.2 | 3.8 | 60.4 | 0.75 |
| | 0.4 | 3.1 | 59.9 | 1.25 |
| | 0.8 | 10.9 | 59.85 | 1.3 |
| | 1.6 | 26.7 | 60.7 | 0.45 |

It is apparent from these results that the flocculants C and D are capable of giving lower turbidity in this test than the coagulants and that they can give lower turbidity at any particular dosage. It will be seen that useful results can be obtained using flocculants at dosages ranging from around 0.025 to 1.6% but that in practice the process is best operated at dosages ranging from around 0.1 to 0.9% with best results being obtained with these flocculants at dosages of around 0.2 to 0.5%. It will also be seen that the flocculants C and D can generally give less brightness loss than equal dosages of coagulants A and B, and in particular the brightness loss at the flocculant dosage that gives near optimum filtrate turbidity can be less than the brightness loss that gives optimum (but usually inferior) filtrate turbidity using coagulants A and B.

EXAMPLE 2

In this example, an actual mill stock for making fine paper, printing paper and writing quality paper and having 23% filler was subjected to various laboratory retention, drainage, drying and formation tests after treatment with various combinations of coagulant A (as above), flocculant E (90 mole % acrylamide with 10 mole % dimethylaminoethyl acrylate quaternised with methyl chloride, intrinsic viscosity 7 dl/g), and bentonite.

When polymer was added to thick stock, it was in each instance subsequently sheared using a large angle blade stirrer diameter 6 cm, shear speed 2,000 rpm. When polymer was added to thin stock, it was subsequently sheared using a propellor stirrer diameter 5 cm, shear speed 1500 rpm. When bentonite was added to the thin stock, the thin stock was then stirred with the same propellor stirrer but at 800 rpm.

All mixing, shearing and retention tests were carried out in a baffled Britt Dynamic Drainage Jar fitted with a 250 μm screen wire.

Retention was determined as a percentage in conventional manner. The suspension was subjected to vacuum drainage to determine the drainage time in seconds (on a scale where increasing time indicates slower drainage), pad solids as a percentage (on a scale where increasing the pad solids indicates better dewatering after drainage and therefore potentially quicker drying), and delta P. Delta P is an indication of the formation or the degree of flocculation within the sheet and lower values indicate better formation.

In the following tables, polymer dosages and bentonite dosages are given in grams per ton, pad solids and retention as a percentage, and vacuum drainage in seconds. Polymer A and the bentonite is always added to the thin stock. Polymer E is added to the thick stock or the thin stock.

Processes where polymer E is added to the thin stock followed by bentonite being added to the thin stock are similar to the processes described in EP-A-235893.

For convenience, the retention values have been quoted in the same tables as the other properties, but experimentally they were determined in separate experiments.

Table 2 shows the results when the high molecular weight polymer is added to the thin stock (as in EP 235893) and Table 3 shows processes according to the invention in which the polymer is added to the thick stock followed by coagulant and/or bentonite to the thin stock. Table 4 shows a modification of the process of EP 235893 wherein coagulant polymer is added after the flocculant polymer has been added to the thin stock, and Table 5 shows a process according to EP 335575, where coagulant polymer is added to the thin stock before the flocculant polymer.

Comparable tests from the various tables are shown in Table 6, to allow a comparison to be made between the processes.

It is apparent from this data, and in particular Table 6, that in these tests the processes of the invention (wherein the flocculant polymer is added to the thick stock) give better formation (lower delta P) than any of the other processes and that the improved formation is accompanied by acceptable retention, pad solids and drainage values. In particular, in the preferred process using flocculant in the thick stock and coagulant polymer followed by bentonite in the thin stock the results show improved formation, improved retention and improved pad solids. The small decrease in drainage performance is commercially acceptable. Indeed, it may be desirable in some modern high speed, high shear, papermaking machines.

TABLE 2

| E Thinstock | Bentonite | Retention (%) | Delta P | Pad Solids | Vacuum Drainage |
|---|---|---|---|---|---|
| 0 | 0 | 69.8 | — | — | — |
| 200 | 4000 | 82.5 | 10 | 32.5 | 19 |
| 400 | 4000 | 82.8 | 11.25 | 32.1 | 14 |
| 600 | 4000 | 84.4 | 14.00 | 31.0 | 10 |
| 1000 | 4000 | 91.1 | 15.5 | 30.2 | 10 |
| 1500 | 4000 | 95.4 | — | — | — |
| 600 | 0 | 79.8 | 7.5 | 32.3 | 27 |
| 600 | 2000 | 84.0 | 13.75 | 30.9 | 11 |
| 600 | 4000 | 84.4 | 14.0 | 31.0 | 10 |
| 600 | 6000 | 83.9 | 12.75 | 31.2 | 13 |

TABLE 3

| E Thick-stock | A | Bentonite | Retention (%) | Delta P | Pad Solids | Vacuum Drainage |
|---|---|---|---|---|---|---|
| 600 | 0 | 0 | 67.3 | — | — | — |
| 600 | 500 | 0 | 70.8 | — | — | — |
| 600 | 1000 | 0 | 71.1 | — | — | — |
| 600 | 2000 | 0 | 71.0 | — | — | — |
| 600 | 0 | 4000 | 80.3 | 7.5 | 31.9 | 20 |
| 600 | 500 | 4000 | 83.7 | 11.75 | — | 13 |
| 600 | 1000 | 4000 | 86.3 | 12 | 32.2 | 12 |
| 600 | 1500 | 4000 | - | 11.0 | 32.8 | 15 |
| 600 | 2000 | 4000 | 81.7 | — | — | — |
| 600 | 4000 | 4000 | 75.4 | — | — | — |

TABLE 4

(E then A then Bentonite)

| E | A | Bentonite | Δ P | Pad Solids (%) | Vacuum Drainage (seconds) |
|---|---|---|---|---|---|
| 600 | 500 | 4000 | 16.0 | 30.4 | 8 |
| 600 | 750 | 4000 | 16.25 | 30.9 | 8 |
| 600 | 1000 | 4000 | 17.0 | 30.8 | 10 |
| 600 | 1500 | 4000 | 16.0 | 31.1 | 10 |

TABLE 5

(A then E Bentonite)

| E | A | Bentonite | Δ P | Pad Solids (%) | Vacuum Drainage (seconds) |
|---|---|---|---|---|---|
| 500 | 600 | 4000 | 16.25 | 30.1 | 9 |
| 750 | 600 | 4000 | 17.05 | 30.0 | 8 |
| 1000 | 600 | 4000 | 18.0 | | 7 |
| 1500 | 600 | 4000 | 17.5 | 30.3 | 8 |

TABLE 6

| | Retention | Delta P | Pad Solids | Drainage |
|---|---|---|---|---|
| E thick then A then Bentonite | 86.3 | 12 | 32.2 | 12 |
| E thick then Bentonite | 80.3 | 7.5 | 31.9 | 20 |
| E thin then Bentonite | 84.4 | 14 | 31.0 | 10 |
| E thin then A then Bentonite | — | 17 | 30.8 | 10 |
| A thin then E then Bentonite | — | 18 | — | 7 |

I claim:

1. A process for making paper comprising forming a thick stock cellulosic suspension having a solids content of at least 2.5% by weight from at least one thick stock component cellulosic suspension having a solids content of at least 2.5% by weight, flocculating the thick stock by adding to the thick stock or to at least one thick stock component suspension a synthetic, substantially water soluble, first, polymeric material having a theoretical cationic charge density of less than 3 meq/g and an intrinsic viscosity of at least 4 dl/g, diluting the flocculated thick stock to form a thin stock having a solids content of not more than 2% by weight, draining the thin stock through a screen to form a sheet, and drying the sheet, wherein a coagulant is added to the thin stock before drainage, the coagulant being selected from the group consisting of cationic inorganic coagulants, second water soluble polymers having an intrinsic viscosity of below 3 dl/g and a theoretical cationic charge density of above 4 meq/g, and mixtures thereof, and anionic colloidal material is added to the thin stock after the coagulant and before drainage.

2. A process according to claim 1, in which the coagulant is a polymer of diallyldimethyl ammonium chloride.

3. A process according to claim 1 in which the anionic colloidal material is an inorganic swelling clay.

4. A process according to claim 1 in which polymeric retention aid is added to the thin stock before drainage.

5. A process according to claim 1 in which the amount of first polymer that is added is an amount sufficient to reduce filtrate turbidity of the thick stock to below 50% of the turbidity in the absence of the polymer.

6. A process according to claim 1 in which the amount of the first polymer is at least 25% of the amount that gives optimum filtrate turbidity of the thick stock.

7. A process according to claim 1 conducted in apparatus utilising one or more of a pulper, thick stock mixing chest and thick stock holding chest, and the first polymer is added to one or more of the pulper, holding chest and mixing chest.

* * * * *